United States Patent [19]

Kageyama et al.

[11] Patent Number: 4,669,904

[45] Date of Patent: Jun. 2, 1987

[54] WRITING INSTRUMENT WITH WEIGHT ACTUATION

[75] Inventors: Hidehei Kageyama; Takahiko Suzuki, both of Kawagoe, Japan

[73] Assignee: Kotobuki & Co., Ltd., Kyoto, Japan

[21] Appl. No.: 703,920

[22] Filed: Feb. 21, 1985

[30] Foreign Application Priority Data

Dec. 7, 1984 [JP] Japan ..... 59-257651

[51] Int. Cl.[4] ..... B43K 24/00; B43K 24/08; B43K 7/12

[52] U.S. Cl. ..... 401/115; 401/109; 401/110

[58] Field of Search ..... 401/115, 111, 110, 109

[56] References Cited

U.S. PATENT DOCUMENTS

| | | | |
|---|---|---|---|
| 3,602,600 | 8/1971 | Kanski | 401/115 |
| 4,315,695 | 2/1982 | dos Santos et al. | 401/115 |
| 4,352,580 | 10/1982 | Ando | 401/115 X |

FOREIGN PATENT DOCUMENTS

| | | | |
|---|---|---|---|
| 659140 | 3/1963 | Canada | 401/115 |
| 1092809 | 11/1960 | Fed. Rep. of Germany | 401/115 |
| 1131555 | 6/1962 | Fed. Rep. of Germany | 401/115 |
| 72009 | 3/1960 | France | 401/111 |
| 505158 | 12/1954 | Italy | 401/115 |
| 563807 | 6/1957 | Italy | 401/115 |
| 797032 | 6/1958 | United Kingdom | 401/111 |
| 869699 | 6/1961 | United Kingdom | 401/115 |

*Primary Examiner*—Steven A. Bratlie

*Attorney, Agent, or Firm*—Sherman and Shalloway

[57] ABSTRACT

A writing instrument comprises a refill disposed slidably along the axial direction in an outer cylinder, a rotating cam set provided in the vicinity of the rear portion of the refill, a weighting balance placed in the vicinity of cam bar of the rotating cam set, a spring member for energizing rearwards the refill, and a knocking portion for operating the cam bar of the rotating cam set. According to the above construction of the writing instrument, when the writing instrument is shaken with force exceeding a certain level, gravity balance functions to project and retract the refill from the outer cylinder, while the refill may also be projected and retracted by knocking motions of the knocking portion.

6 Claims, 7 Drawing Figures

WRITING INSTRUMENT WITH WEIGHT ACTUATION

BACKGROUND OF THE INVENTION

1. Field of the Invention

This invention relates to a writing instrument wherein a refill may be projected and retracted by shaking the writing instrument.

2. Description of the Prior Art

Heretofore, a variety of knocking type writing instruments wherein a refill is projected from its outer cylinder at the time of using such writing instruments have been proposed. In any instruments of this type, however, it is required to knock a knocking portion of such writing instruments by the user, and this inevitably results in changing the manner of holding the writing instrument so that another motion is required for obtaining such a state wherein writing preparations are ready.

SUMMARY OF THE INVENTION

Accordingly it is an object of the present invention to provide a writing instrument in which its refill can be positively projected and retracted by only shaking the writing instrument so that rapid writing becomes possible, whereby the disadvantages as described above can be eliminated.

More specifically, the present invention relates to a writing instrument comprising a refill disposed slidably along the axial direction in an outer cylinder, a rotating cam set provided in the vicinity of the rear portion of said refill, a weighting balance placed in the vicinity of a cam bar of said rotating cam set, and a spring member for energizing the refill rearward, whereby gravity balance is provided for projecting and retracting the refill and functioning in the case when said writing instrument is shaken with force exceeding a certain level in such a manner that said spring member is compressed to depress the refill, thereby operating the rotating cam set.

The present invention relates further to a writing instrument comprising a knocking portion for operating the cam bar of the rotating cam set in addition to the constructional elements of the former writing instrument, whereby the refill may also be projected and retracted by knocking motions of the knocking portion.

The above and other objects of the invention will become apparent from the following detailed description taken in conjunction with the accompanying drawings.

BRIEF DESCRIPTION OF THE DRAWINGS

Referring now to the drawings, wherein like reference characters designate like or corresponding parts throughout the several views.

DESCRIPTION OF THE PREFERRED EMBODIMENTS

An embodiment of the present invention will be described hereinbelow by referring to the accompanying drawings.

Figure 1:
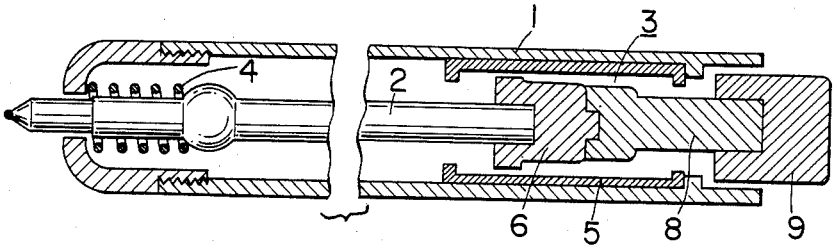
FIG. 1 is a longitudinal sectional view showing a writing instrument of the first embodiment according to the present invention.

In FIG. 1, an outer cylinder 1 contains a refill 2 disposed slidably in the axial direction, a rotating cam set 3 provided in the vicinity of the rear portion of the refill 2, and a spring member 4 for energizing the refill 2 rearward.

Figure 2:
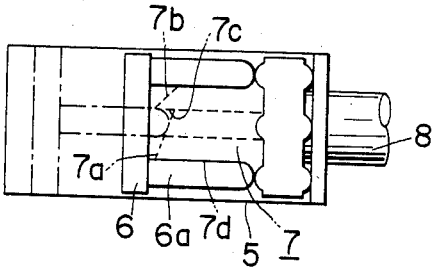
FIG. 2 is a schematic plan view showing a rotating cam set utilized in the writing instrument of the present invention.

As shown in FIGS. 1 and 2, the aforesaid rotating cam set 3 consists of a cam casing 5 fitted into the inner wall of the outer cylinder 1, and a rotor 6 which is slidably contained in the cam casing 5 and the extreme end of which is engaged with the rear end of the refill 2.

Along the inner circumferential surface of the aforesaid cam casing 5, a rotating movement generating part 7 is formed as shown in FIG. 2. The rotating movement generating part 7 is composed of first and second inclined surfaces *7a* and *7b* respectively, a stepped portion *7c*, and a long groove *7d*, and the rotating movement generating part 7 is engaged with the rotor 6 to afford prescribed rotating periodic motion thereto.

On one hand, a switching projection *6a* extending along the axial direction is projectingly provided on the outer circumference of the rotor 6, and the switching projection *6a* is meshed with the rotating movement generating part 7 to be rotated thereby effecting projecting and retracting motions of the refill 2 as mentioned hereunder.

While such cam casing 5 being meshed with the rotor 6 to afford a prescribed rotating period thereto has been provided in the present embodiment, the present invention is not limited thereto, but the aforesaid rotating movement generating part 7 may be directly formed on the inner wall of the outer cylinder 1.

Furthermore a knocking portion 9 as a balance weight is fitted to a cam bar 8 of the rotating cam set 3.

Next, operations and functions of the writing instrument according to the present invention will be described hereinbelow.

In case of writing with the present writing instrument, there are two manners for projecting and retracting the refill 2 so that it is very advantageous.

According to the first manner, the rotating cam set 3 is operated by knocking the knocking portion 9 as in a conventional writing instrument to project and retract the refill 2.

In accordance with the second manner, the whole writing instrument is shaken with force exceeding a certain level. Such shaking motions mean that the refill 2 is shaken towards the extreme end of the outer cylinder 1 with the force exceeding such certain level. The rotating cam set 3 is operated by the shaking motions as in the case of knocking motions to project and retract the refill 2.

In this case, the following relationships:

(1) $(B_1+B_2+B_3+B_4)+D<A<(B_1+B_2+B_3+B_4)+C$, or (2) $(B_1+B_2+B_3+B_4)+D<A<(B_1+B_2+B_3)+C$, or (3) $(B_1+B_2+B_3+B_4)+D<A<(B_1+B_2)+C$, or (4) $(B_1+B_2+B_3+B_4)+D<A<B_1+C$, or (5) $(B_1+B_2+B_3+B_4)+D<A<C$ are valid in respect of the undermentioned respective force:

(1) Energizing force A which energizes rearwards the refill rearward 2 by means of the spring member 4, (2) Gravity $B_1$ of the refill 2, gravity $B_2$ of the rotor 6, gravity $B_3$ of the cam bar 8, and gravity $B_4$ of the knocking portion 9, (3) Forward inertia force C in respect of gravity $(B_1+B_2+B_3+B_4)$ obtained by shaking motions of power more than a certain level, and (4) Forward inertia force D in respect of gravity $(B_1+B_2+B_3+B_4)$ obtained by shaking motions of power less than the above certain level.

Accordingly, the refill 2 and the rotating cam set 3 are not operated by merely directing downwardly the writing instrument or affording shaking motions of power less than such certain level. However, when the writing instrument is shaken with power more than the above certain level, the refill 2 which has been contained in the outer cylinder 1 proceeds against energized force by means of the spring member 4 in accordance with the quite same manner as usual knocking motions to project the refill 2 from the outer cylinder 1 through delivery motions thereof by the rotating cam set 3, whereby the writing instrument becomes in a state in which writing preparations are ready.

On the other hand, in the case when the refill 2 is retracted into the outer cylinder 1 after completing writing, the writing instrument is again shaken in accordance with the quite same manner as that described above so that ordinary releasing knocking is effected, and the refill 2 is retracted into the outer cylinder 1 through the rotating cam set 3 by energizing force of the spring member 4, whereby the refill 2 returns to the original state again.

Thus, in accordance with the present invention, the refill 2 can be projected and retracted by selecting either of the two manners. In case of shaking motions, the refill 2 can be projected and retracted by merely shaking the writing instrument so that faster operation than that of knocking motions can very simply be attained without changing the manner of holding the writing instrument. Furthermore, since the refill 2, the rotating cam set 3 and the like may be housed in the outer cylinder 1 from the rear end thereof, assembly operation of them is simple and reduction of the number of parts to be used may be intended, so that very inexpensive writing instruments can be manufactured.

Figure 3:
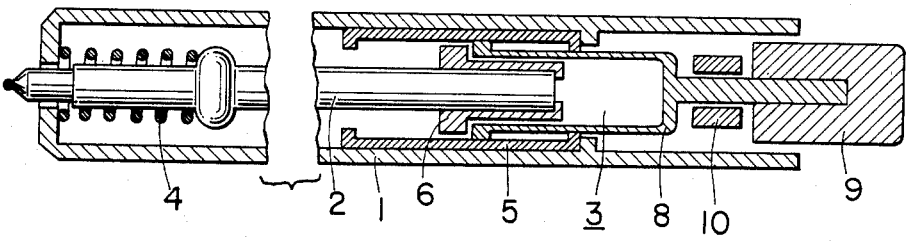
FIG. 3 is a longitudinal sectional view showing a writing instrument of the second embodiment according to the invention.

FIG. 3 is a longitudinal sectional view showing the writing instrument of another embodiment according to the present invention wherein a weighting balance 10 for assisting projecting and retracting motions of a refill 2 is loosely disposed between a cam bar 8 and a knocking portion 9.

In this second embodiment, the refill 2 can also be projected and retracted by said two manners as in the case of the first embodiment besides, the refill 2 is more positively projected and retracted by shaking motions in the present embodiment. In this case, the same relationships with those mentioned above are valid in respect of the respective force in the present embodiment. The aforesaid weighting balance 10 may be integrally formed with the cam bar 8.

Figure 4:
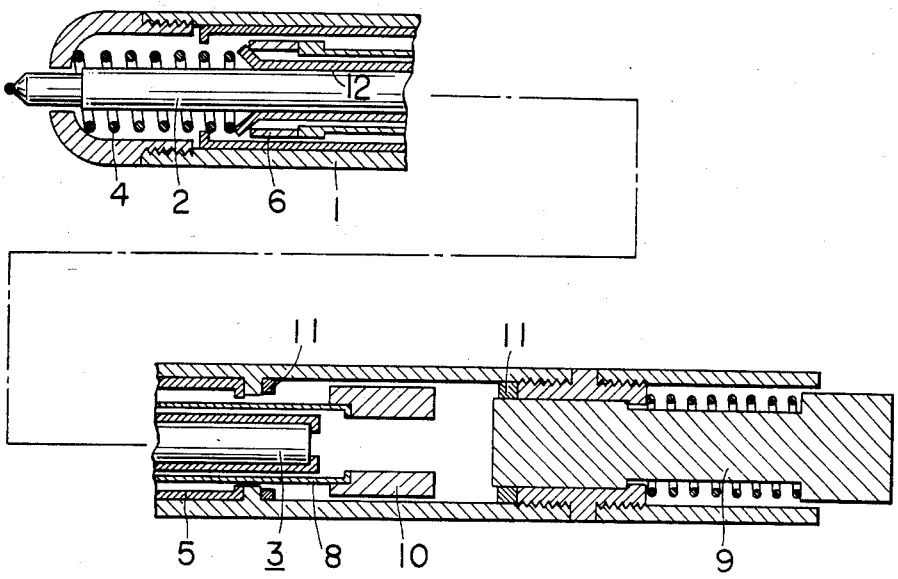
FIG. 4 is a longitudinal sectional view showing a writing instrument of the third embodiment according to the invention.

FIG. 4 is a longitudinal sectional view showing the writing instrument of still another embodiment according to the invention wherein a refill stopper 11 being a shock absorbing member is interposed between a cam bar 8 and a refill 2. In this third embodiment, the same relationships with those mentioned above are also valid in respect of the respective force besides, the refill 2 can be projected and retracted by said two manners.

Figure 5:
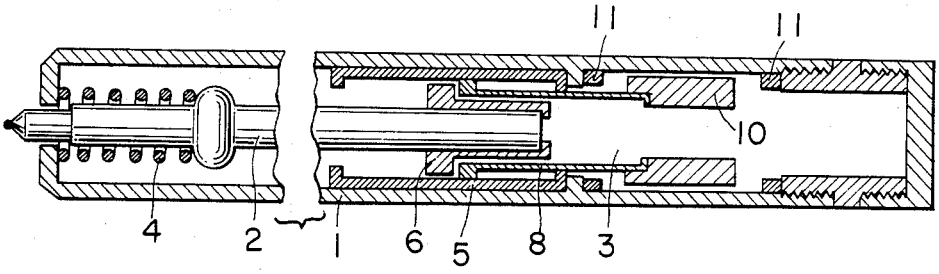
FIG. 5 is a longitudinal sectional view showing a writing instrument of the fourth embodiment according to the invention.
Figure 6:
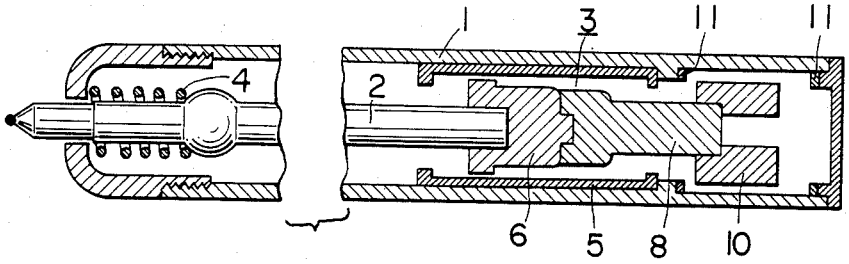
FIG. 6 is a longitudinal sectional view showing a writing instrument of the fifth embodiment according to the invention.
Figure 7:
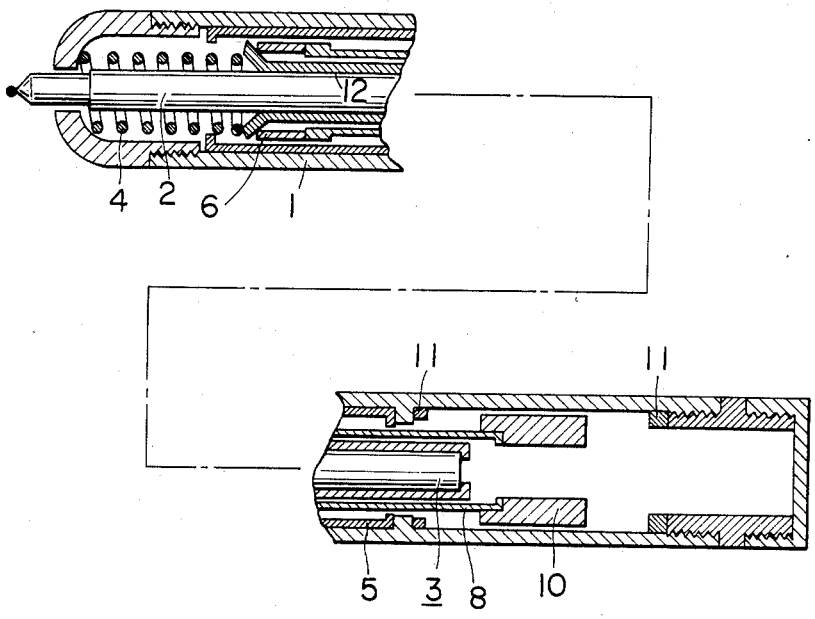
FIG. 7 is a longitudinal sectional view showing a writing instrument of the sixth embodiment according to the present invention.

FIGS. 5, 6, and 7 are longitudinal sectional views each showing the writing instrument of yet another embodiment according to the present invention wherein a weighting balance 12 (FIG. 7) is slidably contained in an outer cylinder 1 at the rear end of a cam bar 8, and a refill 2 is projected and retracted by only shaking motions of the writing instrument. In these embodiments, each weighting balance 12 may be formed integrally with or separately from each cam bar 8 or the like. In these fourth, fifth, and sixth embodiments, the same relationships with those mentioned above are also valid in respect of the respective force.

In accordance with the present invention, as described above, various advantages exist such that the refill can be projected and retracted by merely shaking the writing instrument so that easy and rapid writing becomes possible. Besides its assembly operation is simple, and the number of parts to be used may be reduced, whereby inexpensive writing instruments can be provided and are obtained.

While the present invention has been described with reference to the preferred embodiments thereof, many modifications and alterations may be made within the spirit and scope of the invention.

What is claimed is:

1. A writing instrument comprising:

(a) a refill axially slidable in an outer cylinder between a retracted position and a projected position;

(b) a rotating cam set which is located in the vicinity of the rear of the refill and which includes a cam bar for operating the cam set to move the refill between its retracted and projected positions;

(c) a spring member for biasing the refill rearwardly toward the retracted position;

(d) a hollow inertial weight which is slidable within the outer cylinder rearward of the cam bar so that, when the cylinder is shaken with a force in excess of a given level, the refill is depressed against the bias of the spring member and the cam set is operated to retract or project the refill; and (e) an operating plunger extending through said hollow inertial weight and projecting from the rear of the outer cylinder for the manual operation of the cam bar, whereby the refill may be projected and retracted either by a shaking motion or by manual operation of the plunger.

2. A writing instrument according to claim 1, wherein the plunger forms at least a part of the inertial weight.

3. A writing instrument according to claim 1, wherein the inertial weight is loosely disposed between the cam bar and the plunger.

4. A writing instrument according to claim 1, wherein a refill holder is interposed between the cam bar and the refill.

5. A writing instrument according to claim 1, wherein the inertial weight is separate from the cam bar.

6. A writing instrument according to claim 1, wherein when the rotating cam set is operated by shaking motion in order to project and retract the refill, the following relationships:

1. $(B_1+B_2+B_3+B_4)+D<A<(B_1+B_2+B_3+B_4)+C$, or
2. $(B_1+B_2+B_3+B_4)+D<A<(B_1+B_2+B_3)+C$, or
3. $(B_1+B_2+B_3+B_4)+D<A<(B_1+B_2)+C$, or
4. $(B_1+B_2+B_3+B_4)+D<A<B_1+C$, or
5. $(B_1+B_2+B_3+B_4)+D<A<C$, are valid in respect to the undermentioned respective forces:

(1) Rearward bias force A which is applied to the refill by the spring member, (2) Weight $B_1$ of the refill, weight $B_2$ of the rotor of the cam set, weight $B_3$ of the cam bar, and weight $B_4$ of the plunger, (3) Forward inertial force C in respect of the weight $(B_1+B_2+B_3+B_4)$ obtained by shaking with a power greater than the given level, and (4) Forward inertial force D in respect of the weight $(B_1+B_2+B_3+B_4)$ obtained by shaking with a power less than the given level.

* * * * *